United States Patent [19]

Underwood

[11] 4,235,552

[45] Nov. 25, 1980

[54] FLUID MIXING SYSTEM

[75] Inventor: Gene E. Underwood, Casper, Wyo.

[73] Assignee: 3U Partners, Casper, Wyo.

[21] Appl. No.: 30,367

[22] Filed: Apr. 16, 1979

Related U.S. Application Data

[63] Continuation-in-part of Ser. No. 810,590, Jun. 27, 1977, Pat. No. 4,170,420, which is a continuation-in-part of Ser. No. 722,668, Sep. 13, 1976, abandoned.

[51] Int. Cl.[3] ..... B01F 15/02; B01F 5/10

[52] U.S. Cl. ..... 366/137; 366/165

[58] Field of Search ..... 366/137, 165, 27, 40, 366/51, 131, 159, 173, 176, 177, 28, 34, 136, 166, 172

[56] References Cited

U.S. PATENT DOCUMENTS

| | | | |
|---|---|---|---|
| 1,192,478 | 7/1916 | Vandercook | 366/165 |
| 1,436,700 | 11/1922 | Eliel | 366/173 |
| 1,669,962 | 5/1928 | Wihlfahrt | 366/173 |
| 1,706,418 | 3/1929 | Sissom | 366/173 |
| 1,986,019 | 1/1935 | Shaffner | 366/137 |
| 2,322,087 | 6/1943 | Atwood | 366/165 |
| 2,432,175 | 12/1947 | Schmidt | 366/165 |
| 2,469,825 | 5/1949 | Hornstein | 366/165 |
| 3,491,949 | 1/1970 | Hairston | 366/134 |
| 3,531,093 | 9/1970 | Karpacheva | 366/165 |

*Primary Examiner*—Robert W. Jenkins

*Attorney, Agent, or Firm*—Wofford, Fails & Zobal

[57] ABSTRACT

A system for mixing fluids such as drilling fluids and which comprises an elongated container having a cylindrical shaped bottom. A suction conduit has an inlet in fluid communication with the interior of the container at about its central axis for withdrawing fluid from the container. An exterior conduit extends along the length of the container and has a plurality of spaced apart injection conduits extending into the container for injecting fluid therein in a direction to cause the fluid to swirl around the central axis of the container. A pump has its inlet coupled to the suction conduit and its outlet coupled to one end of the exterior conduit to cause the fluid in the container to spiral inward for flow through the suction conduit and to be pumped into the exterior conduit for injection through the injection conduits back into the container. An air bleed is provided for removing air from the interior of the container near its axis.

2 Claims, 18 Drawing Figures

Fig. 4
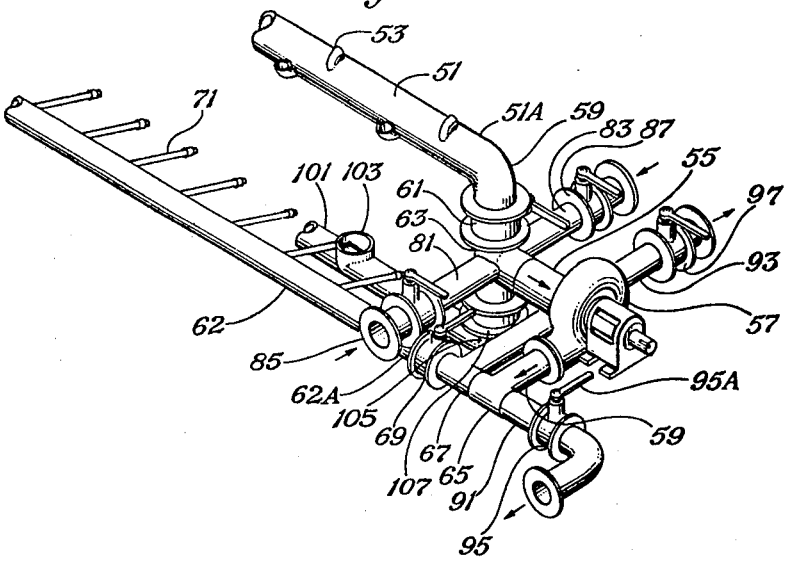
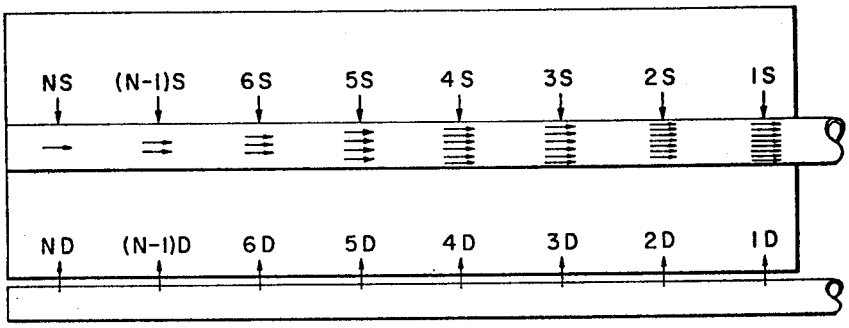
Fig. 6

Fig.8
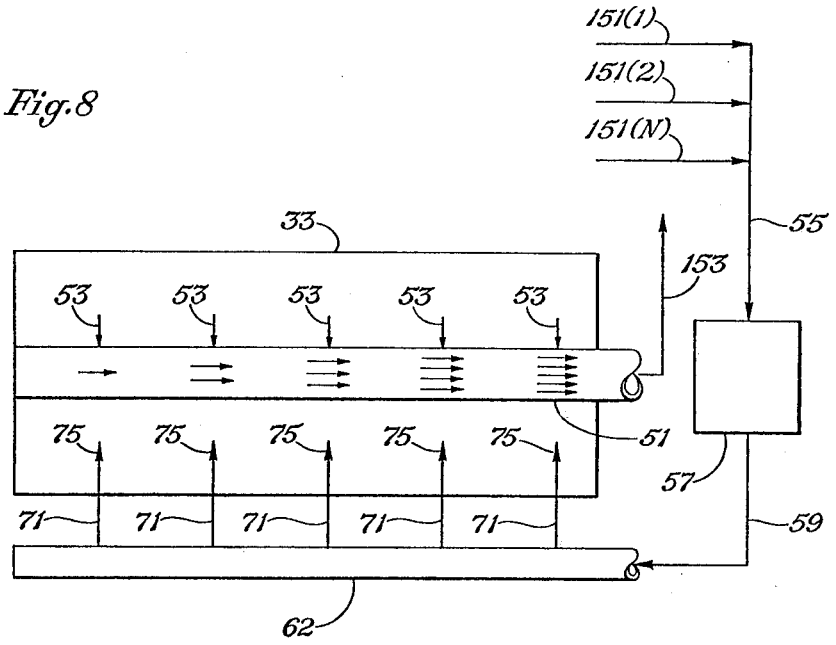
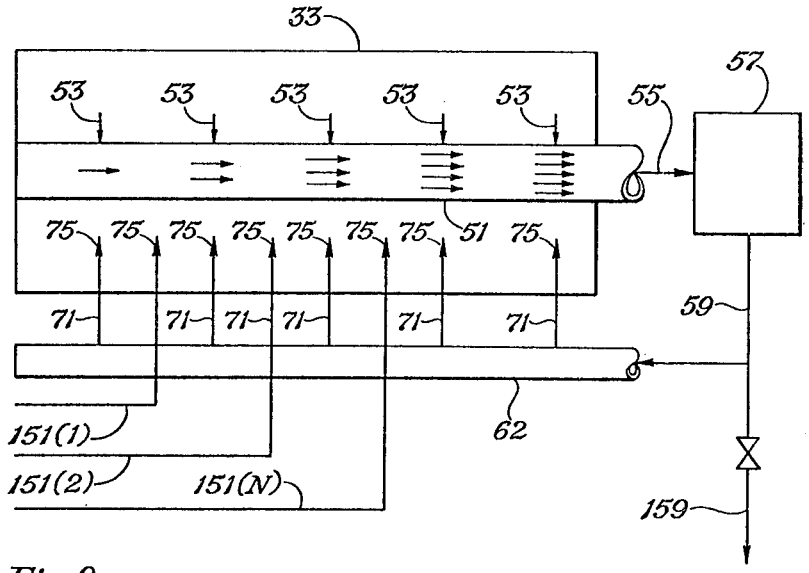
Fig.9

FLUID MIXING SYSTEM

This application is a continuation-in-part of U.S. Pat. application Ser. No. 810,590, filed June 27, 1977, now U.S. Pat. No. 4,170,420, which is a continuation-in-part of U.S. Pat. application Ser. No. 722,668 filed Sept. 13, 1976, now abandoned.

BACKGROUND OF THE INVENTION

Present mud mixing systems consume excessive time to properly blend drilling fluids. Also, the preparation of packer fluids and workover fluids require excessive time. This has disadvantages from the standpoint of cost. In addition while preparing a drilling fluid, drilling cannot proceed. In the case of the lost circulation, considerable time can be lost preparing sufficient drilling fluid as needed. In the case of a blow out, the speed of obtaining a properly weighted drilling fluid quickly can mean the difference between an oil well fire or saving the well.

SUMMARY OF THE INVENTION

It is an object of the present invention to provide a fluid mixing system for rapidly and effectively mixing materials such as chemicals or particles with a liquid to form a desired fluid for the drilling industry or other purposes.

The fluid mixing system comprises a container having a given length for holding the fluid to be mixed. Injection means is provided for injecting fluid into the container at a plurality of spaced apart positions along its length. Conduit means is provided having inlet means in fluid communication with the interior of the container at about its central axis for the flow of fluid from said container into said conduit means. In addition pump means is provided for withdrawing fluid from said conduit means and for flowing said withdraw fluid into said injection means for injection back into said container. An air bleed removes air from the interior of the container near its axis.

BRIEF DESCRIPTION OF THE DRAWINGS

FIG. 4 is a perspective view of the pumping and circulating system used in the mixing system but with the container of FIGS. 1–3 removed for purposes of clarity;

FIG. 6 schematically illustrates fluid flow from the exterior header into the central suction conduit located in the container of the mixing system;

FIG. 8 is a schematic view of a continuous mixing system;

FIG. 9 is a schematic view of a continuous mixing system with recirculation.

DETAILED DESCRIPTION OF THE INVENTION

Figure 1:
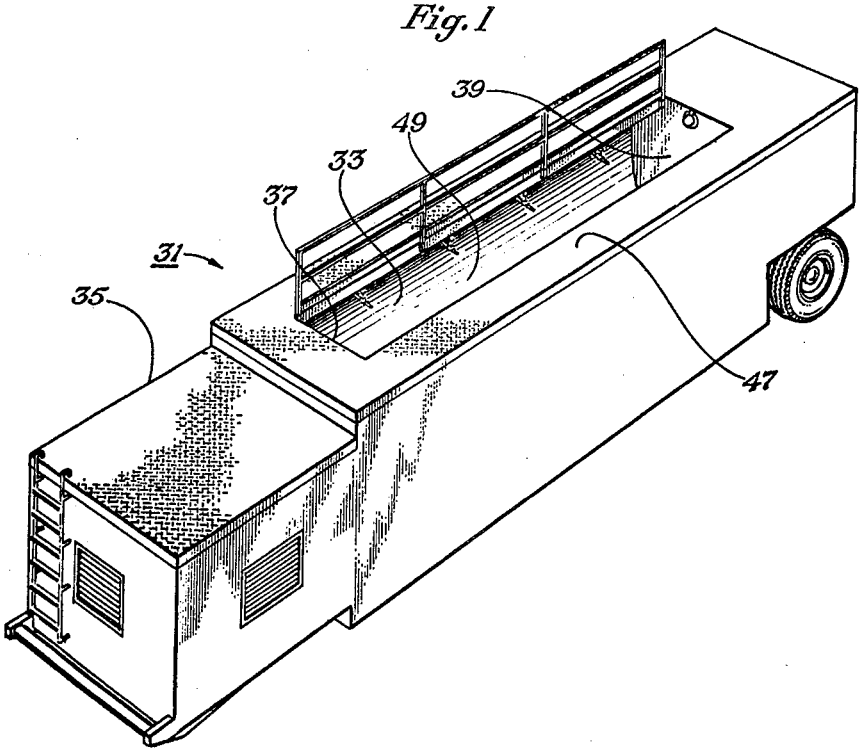
FIG. 1 is a perspective view of a mixing system mounted in a mobile unit.
Figure 2:
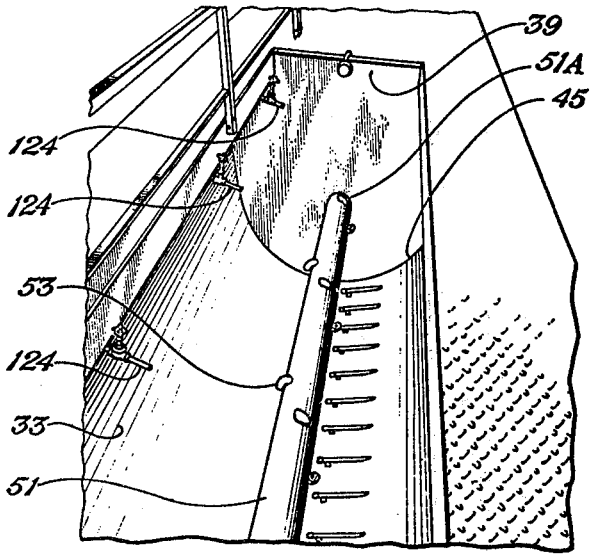
FIG. 2 is a view of FIG. 1 looking down into the container or vessel of the mixing system.

Referring now to the drawings, the fluid mixing system is identified at 31 and comprises a fluid container or vessel 33 and a mixing system for preparing drilling fluids for the drilling industry although it may be employed for preparing fluids for other uses. The drilling fluid prepared may be water based or oil based and may be prepared by mixing chemicals or other particles with water or oil to obtain a homogenous solution or a heterogenous mixture.

The container 33 is supported by a mobile unit 35. It is elongated and is formed by two spaced apart end walls 37 and 39, two side walls 41 and 43 and a rounded bottom 45 extending between the end walls. The bottom 45 forms half of a cylinder. The side walls are straight and extend upward from opposite edges of the bottom. A top wall 47 is connected to the upper edges of the end walls 37 and 39 and side walls 41 and 43. Formed through the top wall 47 is a rectangular shaped opening 49 through which the material to be mixed may be dumped or pumped into the container.

Located in the container 33 and extending along its central axis is a suction pipe or conduit 51. The suction conduit extends from end wall 37 to end wall 39 and has a plurality of inductor inlets 53 equally spaced apart along its length. End 51A of the conduit 51 is coupled to the inlet 55 of a centrifugal pump 57 which is located on the exterior of the container. Connection of the suction conduit 51 to the inlet 55 is by way of an elbow 59, a valve 61 and a conduit joint 63.

Figure 3:
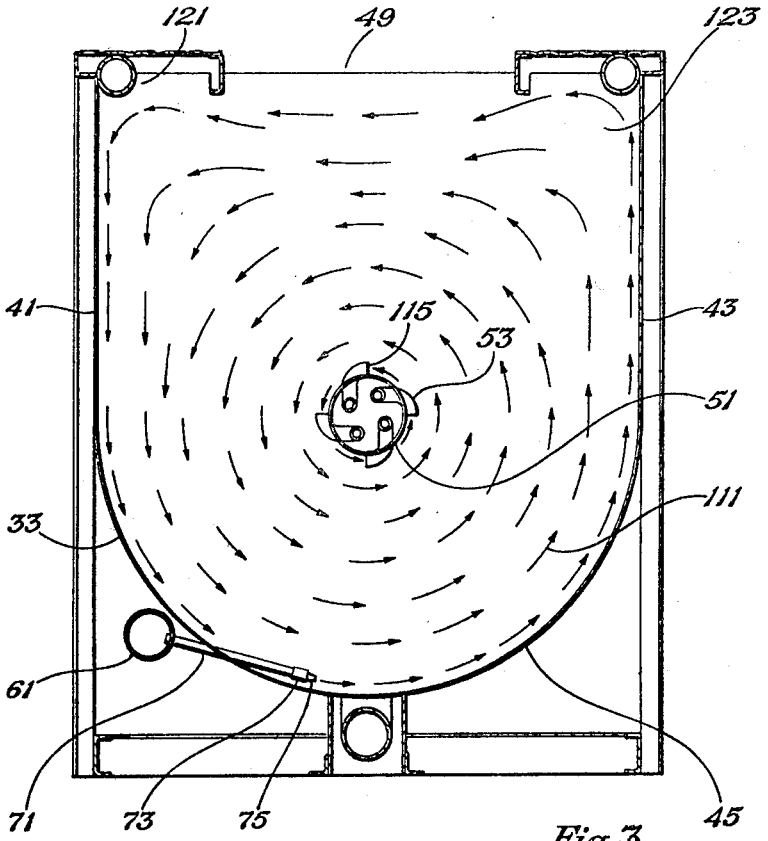
FIG. 3 is a cross-sectional view of the container of FIGS. 1 and 2.

The outlet 59 of the pump 57 is coupled to one end 62A of a conduit or header 62 which is also located on the exterior of the container 33 and extends along the length thereof. Connection of the outlet 59 to the header 62 is by way of conduit 65, conduit 67, and valve 69. Extending from the conduit 62 are a plurality of spaced apart injector conduits 71 which extend into the container 33 for injecting fluid into the container. The injector conduits 71 are equally spaced apart and are equal in number to the number of inductor conduits 53. The ends of the injector conduits have couplings 73 attached thereto to which are attached injector nozzles 75. As seen in FIG. 3 the injector conduits 71 extend into the container 33 tangentially with respect to the curved bottom wall 45.

Also coupled to the conduit joint 63 and hence to the inlet 55 of the pump are two external intake conduits 81 and 83. Valves 85 and 87 are connected to the conduits 81 and 83 respectively. Two external discharge conduits 91 and 93 are coupled to the outlet 59 of the pump 57. In this respect, discharge conduit 91 is coupled to the outlet 59 by way of conduit 65 and discharge conduit 93 is coupled to the outlet 59 by way of conduits 67 and 65. Valves 95 and 97 are connected to conduits 91 and 93 respectively.

A lower suction conduit 101 is located below the container and has a plurality of inlets 103 which are in fluid communication with the bottom of the container 33. Only one inlet 103 is shown although preferably there will be four of such inlets. The lower suction conduit 101 is connected to the inlet 55 of the pump by way of an elbow 105, a valve 107 and conduit joint 63.

In operation, the chemicals or particles to be mixed with a liquid are dumped into the container either manually or by way of hopper (not shown). Chemicals also may be pumped into the container. Either of the external intakes 81 or 83 will be connected to the source of liquid (oil or water) to be mixed with the chemical or particles added into the container. Assume that external intake 81 is connected to a liquid source. In addition either or both of the external discharge conduits 91 or 93 will be connected to the facility to which the mixed fluid is to be transported. Assume that external discharge conduit 91 is connected to a mud pump which in turn is connected to a well into which drilling fluid is to be injected. Initially all of the valves 61, 69, 85, 87, 95, 97 and 107 will be closed. These valves may be opened or closed by operating the levers shown. For example, the operating lever of valve 95 is identified at 95A. Valves 69 and 85 will be opened and the pump 57 started to cause the liquid to be pumped from the external intake 81 to the conduit 61. Flow is by way of external intake 81, conduit joint 63, pump intake 55, pump 57, pump outlet 59, conduit 65, conduit 67, valve 69 and then to header conduit 62. From the header 62 the liquid is injected into the container by way of the injection conduits 71. The container 33 is filled until the liquid reaches a desired level above the center suction conduit 51 dependent upon the calculated ratio of liquid to chemicals or particles to be mixed. When the container has been filled to the desired level valve 85 is closed and valve 61 opened. This causes the liquid in the container to flow through the inductor inlets 53 and into the suction conduit 51 and then to the pumped back into the header 62 and injected back into the container by way of the injector conduits 71. Flow from the center suction conduit 51 is by way of elbow 59, valve 61, conduit joint 63, pump inlet 55, pump 57, pump outlet 59, conduit 65, conduit 67, valve 69, header 62 and injection conduits 71. Thus, the liquid is circulated from the container into the inductor inlets and through the center section conduit 51, the pump, the header 62, and back into the container by way of the injector conduits 71. As stated above, the injector conduits are located such that fluid is injected from their nozzles tangentially to the curvature of the container bottom whereby the fluid injected follows a circular path around the container and hence around the center section conduit 51 as depicted by the arrows 111.

Figure 5:
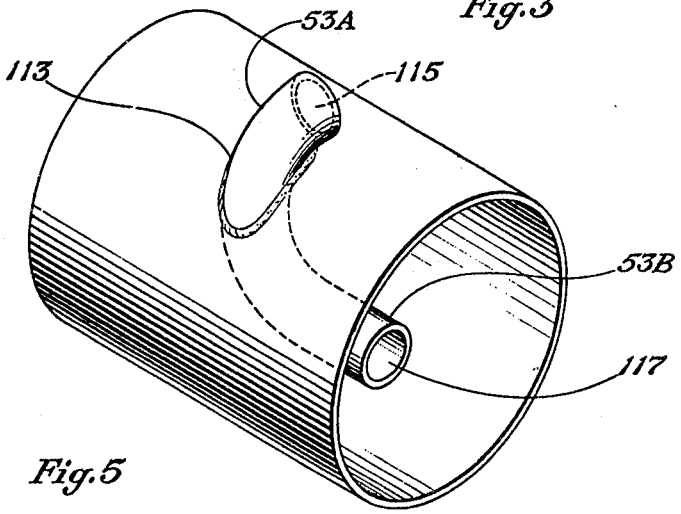
FIG. 5 is an enlarged perspective view of a portion of the central suction pipe or conduit employed in the container of FIGS. 1–3 and which illustrates one of the inductor inlets.

The fluid injected into the circular path causes the fluid in the tank to swirl with it whereby a secondary flow is induced and a sweep action is obtained across the bottom of the container which prevents chemicals or other materials from settling to the container bottom. The suction drawn on the suction conduit 51 by the centrifugal pump causes the fluid in the container 33 to spiral inward around the suction conduit. As the fluid spins inward the velocity increases and a pressure drop is experienced between the exterior and interior wall of the suction conduit 51 which would be detrimental to the quantity of fluid pumped through the suction conduit 51 if the inductor inlets 53 were merely perforations formed in the wall of the suction conduit 51. The effect of the pressure drop is overcome by the use of the inductor conduits 53. Referring to FIG. 5 each inductor conduit comprises a conduit 53 extending through an opening 113 formed in the wall of the suction conduit 51 and has a portion 53A located outside of the suction conduit 51 and a portion 53B located inside of the suction conduit. The exterior portion 53A is turned to have its opening 115 facing in a direction opposite the direction of flow of the fluid around the suction conduit 51 such that a pressure impact is created against the opening 115 of the inductor 53. Thus, velocity is converted to pressure and the effect of the pressure drop is overcome whereby a large quantity of fluid may be pumped through the suction conduit 51. The outlet of conduit portion 53A into conduit 51 is off center with respect to the axis of conduit 51. In order to prevent the fluid flowing through conduit 53A from swirling inside conduit 51 and to start the fluid flowing to the pump, the inside portion 53B of the inductor has its opening 117 facing in the direction of the flow of the fluid in the suction conduit 51 to the centrifugal pump as seen in FIG. 5.

In one embodiment, 24 inductors 53 and 24 injector conduits 71 are employed. The inductors 53 are equally spaced apart and are each of the same size whereby an equal quantity of fluid will be extracted through the suction conduit 51 at 24 equally spaced locations along the length of the suction conduit. This is depicted by FIG. 6 where NS represents the number of inductors and ND represents the number of injector conduits. The flow at IS will be comprised of N number of components from the container at N locations. This action will promote the establishment of a homogenous mixture flowing from the container through the suction conduit 51. The fluid will be further mixed by passing through the pump 57 due to turbulence or high shearing caused by the blades or vanes of the centrifugal pump. The injector conduits 71 are equally spaced apart and the injector conduits including their nozzles 75 are of the same size. Thus, from the pump, each quantity of fluid has an equal chance of being injected through any one of the 24 equally spaced apart injector conduits which promotes further mixing.

Inside the container 33, turbulence is created at the upper corners 121 and 123 due to the fact that these corners are not rounded. This is desirable since it enhances mixing of the chemicals or particles and the liquid. Extraction of a better mixed fluid from the container also is achieved by locating the suction conduit 51 in the center rather than at the periphery of the container. In this respect, if the extracting suction conduit 51 were located at the periphery of the container, a large mass of rotating fluid would exist in the center which would not be properly mixed whereby maximum mixing would not be achieved.

As indicated above, it has been assumed in this example that the external discharge conduit 91 is connected to a mud pump which in turn is connected to the drill pipe inside of a well into which drilling fluid is to be injected. When the liquid has been mixed properly, valves 107 and 95 are opened and valves 69 and 61 are closed whereby the fluid in the container is pumped to the external discharge conduit 91 by way of inlets 103, lower suction conduit 101, elbow 105, valve 107, conduit joint 63, inlet 55, pump 57, outlet 59, and conduit 65. Since the lower suction conduit 101 is located below the bottom of the container, 100% of the fluid can be evacuated from the container leaving nothing in the container which is important if the fluid is expensive which generally is the case for drilling fluid.

Location of the header conduit 62 outside rather than inside the container has advantages since it avoids the collection of materials (which do not go into solution) behind the header which would otherwise occur if the header were located in the container next to its wall. Although the header 62 is disclosed as being located at the bottom of the container it is to be understood that it could be located at other positions as long as secondary flow can be induced to achieve a sweep across the bottom of the container to prevent chemicals from dropping out and settling to the bottom.

Examples of chemicals which may be mixed with water or oil in the present system to form drilling fluids are as follows: Barium sulfate, Calcium carbonate, high yielding clay, sodium chloride, etc. Examples of other materials which may be mixed with oil or water in the present system to form a drilling fluid are ground paper, walnut hulls, mica, cotton seed, etc.

In one embodiment, the container 33 has a length of 24 feet, a height of 8½ feet and a width of 7½ feet. The capacity of the container is 215 barrels of liquid with a top liquid level one foot below the top of the container and 255 barrels at full capacity. Suction tube 51 has a diameter of about 10 inches and the header 62 has a diameter of about 8 inches. The inductors 52 are spaced one foot apart and each has a diameter of two inches. The injection conduits 71 are spaced one foot apart. Each injection conduit 71 is a one inch schedule 80 rated pipe with a coupling threaded thereto and a nozzle threaded into the coupling. The diameter of each nozzle is the same and may be from ⅝ to 0.957 inch. The lower suction pipe 101 has a diameter of 8 inches and has four equally spaced inlets 103. The centrifugal pump 57 is a Byron Jackson centrifugal pump having a 6 inch diameter outlet and an 8 inch diameter inlet. It has a hydraulic horsepower output of 110 h.p. at 1800 rpm with water, and a water rating of nearly 2000 gallons per minute. It is run at about 1800 rpm by a 4–71 Detroit diesel having an output of about 160 h.p. This embodiment of the fluid mixer can change out the entire content of the container 33 in four minutes and 12 seconds which is approximately 12 times faster than any known mixer in existance.

It is to be understood that the mixing system may have dimensions other than that disclosed above and employ a pump with a different flow and pressure rating.

Although the bottom 45 of the container 33 preferably is cylindrical in shape it could have other curved shapes to promote streamline flow. In addition, although the pump 57 is a centrifugal pump other types of pumps could be used such as a piston type pump, a gear pump, etc.

In some cases, it may be desirable to mix only a small quantity of liquid with a desired amount of chemical or particles such that the liquid desired to be mixed does not reach to the level of the suction conduit 51. In this case, the lower suction conduit 101 will be used rather than the central suction conduit 51 to extract the liquid from the container for re-circulation to the container by way of the pump 57, the header 61 and the injection conduits 71. Assuming that the chemical or particles have been dumped into the container and the container filled with liquid to the desired level, mixing is carried out by opening valves 107 and 69 to extract the fluid from the container by way of the inlets 103, the lower suction conduit 101, the pump 57, and then to re-inject the fluid into the container through the header 62 and the injection conduits 71. In this case, valves 61 will be closed during the circulation and hence mixing operation. After mixing has been achieved, the fluid is pumped from the container to the desired facility in the same manner described above with respect to the preferred embodiment.

The purpose of the top header jet conduits 124 is to wet lost circulation material during mixing which may float on top of the liquid. The jet conduits 124 are connected to a top header (not shown) which is connected to the pump outlet 59 by means not shown, whereby a portion of the fluid injected through the outlet 59 will be injected through the top header and then injected into the container by way of the jet conduits 124. In most instances the top header and jet conduits 124 will not be used.

Figure 7:
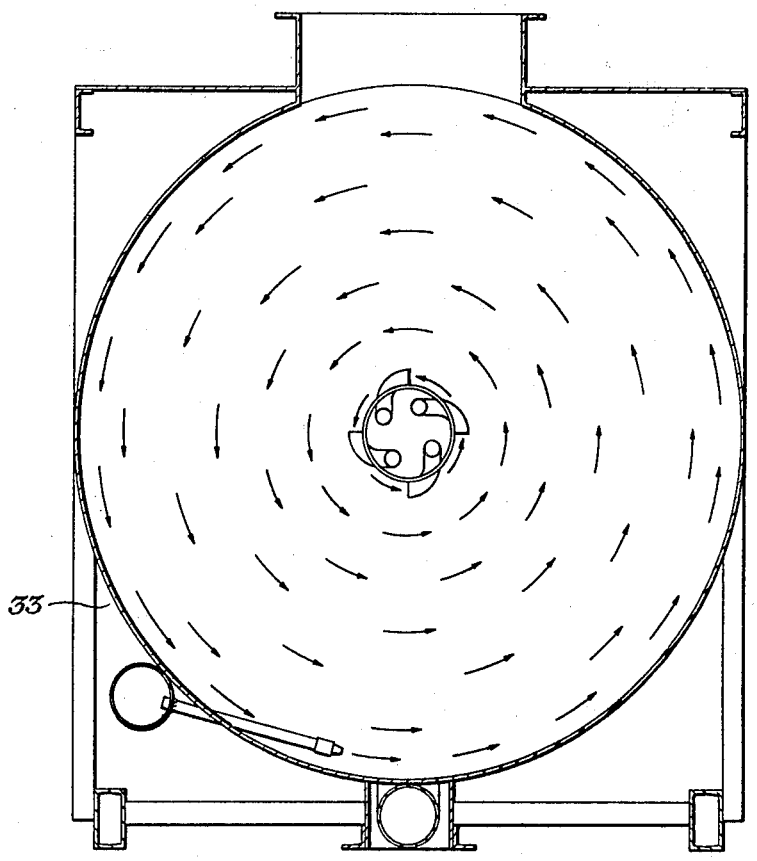
FIG. 7 is a cross-sectional view of a modified container which may be employed in the mixing system.

Referring to FIG. 7, there is disclosed another embodiment wherein the container 33 is in the form of a cylinder and does not have the straight upper side walls and top as does the embodiment of FIG. 1. This system operates in the same manner as that of the embodiment of FIG. 1, however, the turbulence at the upper corners 121 and 123 is eliminated since these right-angle corners have been eliminated. Thus, the embodiment of FIG. 7 will achieve maximum flow through the pump where maximum shearing occurs on the fluid due to the rotating action of the blades or vanes of the centrifugal pump.

In certain instances, it may be desirable to provide vortex generators in the container of the embodiment of FIG. 7 to obtain swirl or turbulence to enhance mixing of the chemicals or particles with the liquid. Such vortex generators may comprise a piece of metal with a helical twist, located to cause a secondary swirl in the direction of flow to create more shear and hence turbulence.

Although it is desirable to have turbulence within the container 33 it is more desirable to have an even flow around the suction conduit 51. This is achieved by locating the various inductors 53, 90° apart. It is to be understood, however, that the inductors could be all lined up with respect to each other if desired. In the preferred embodiment, the number of inductors 53 are equal to the number of injectors 71, however, in some cases the number of inductors may not be equal to the number of injectors. Similarly, in the preferred embodiment, the inductors 53 and the injectors 71 are equally spaced apart, however, in some cases they may not be equally spaced apart.

The system disclosed is a batch mixing system where the fluid in the container 33 is re-circulated through the pump 57 and back to the container 33. A continuous mixing system may be employed wherein the input 55 to the pump 57 is connected to an external fluid source and the output of the pump 57 is connected to the header 62. The output of the center conduit 51 will be connected to an external destination. The system will be operated as described previously, however, the fluid will not be re-circulated but will be mixed and then directly supplied to an external destination for its intended purpose. Such a system may be used in the chemical industry, sewage treatment, etc.

FIG. 8 is a schematic view of a continuous mixing system. In the embodiment of FIG. 8, like reference numerals identify like components as that shown in FIGS. 1–6. In the system of FIG. 8, the input 55 of the pump 57 is connected to one or more liquid conduits 151(1), 151(2), 151(N) and the output 59 of the pump 57 is connected to the header 62. The output of the center conduit 51 is connected to an external destination by way of conduit 153. The chemicals or particles to be mixed with a liquid are dumped into the container 33 either manually or by way of a hopper (not shown). Chemicals also may be pumped into the container. One or more types of liquids are fed to pump input 55 by way of conduits 151(1), 151(2), 151(N). The mixed fluid discharged through conduit 153 will be discharged at the same rate at which the various materials and liquids are added to the container 33.

FIG. 9, is a schematic view of another continuous mixing system wherein recirculation also is achieved. In the embodiment of FIG. 9 like reference numerals identify like components as that shown in FIGS. 1–6 and 8. In the system of FIG. 9, the chemicals or particles to be mixed with a liquid are dumped into the container 33 either manually or by way of a hopper (not shown). Chemicals also may be pumped into the container. One or more types of liquids are fed into the container by way of conduits 151(1), 151(2), 151(N). The output of center conduit 51 is coupled to the input 55 of the pump 57 and the output 59 of the pump 57 is fed back to header 62 and to an external source by way of conduit 159. The mixed fluid discharged through conduit 159 will be discharged at the same rate at which the various materials and liquids are added to the system.

Figure 10:
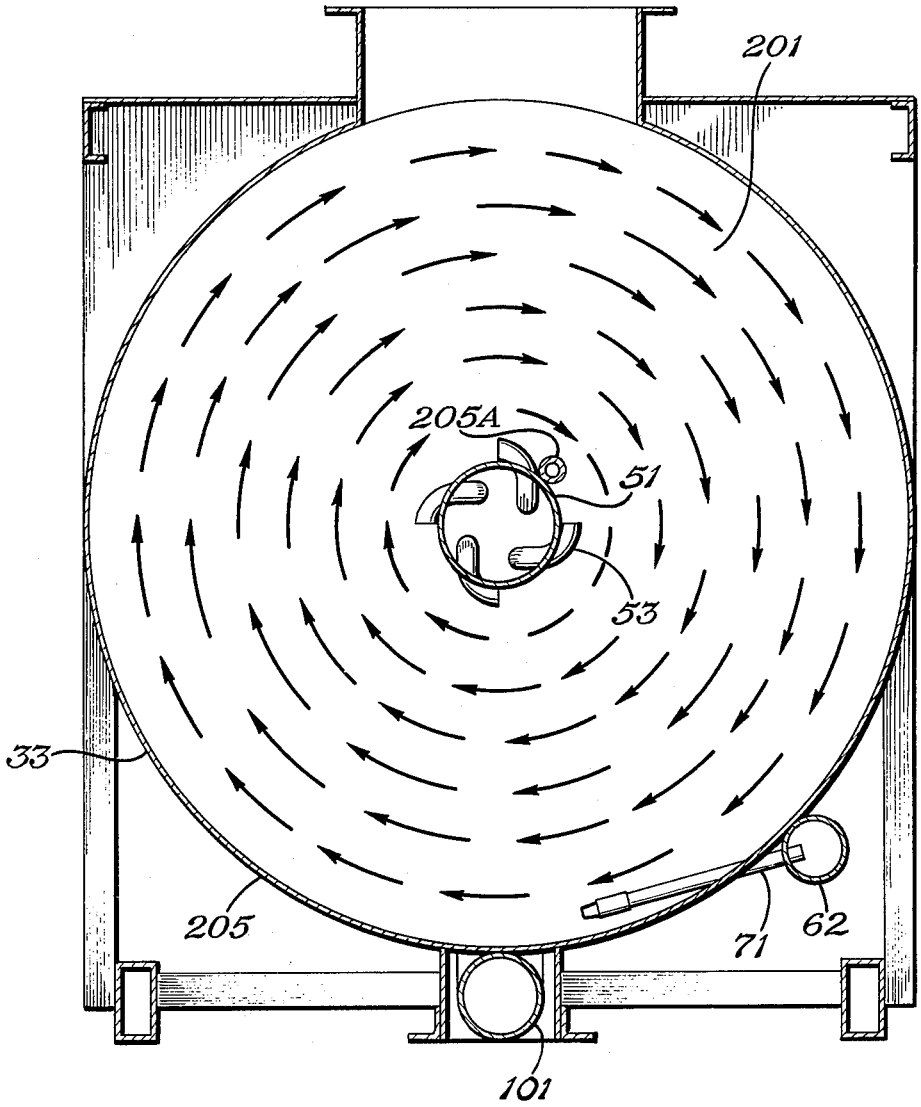
FIG. 10 is a cross-section of a cylindrical container as seen from a direction opposite of that of FIG. 7 and illustrating an air bleed.
Figure 11:
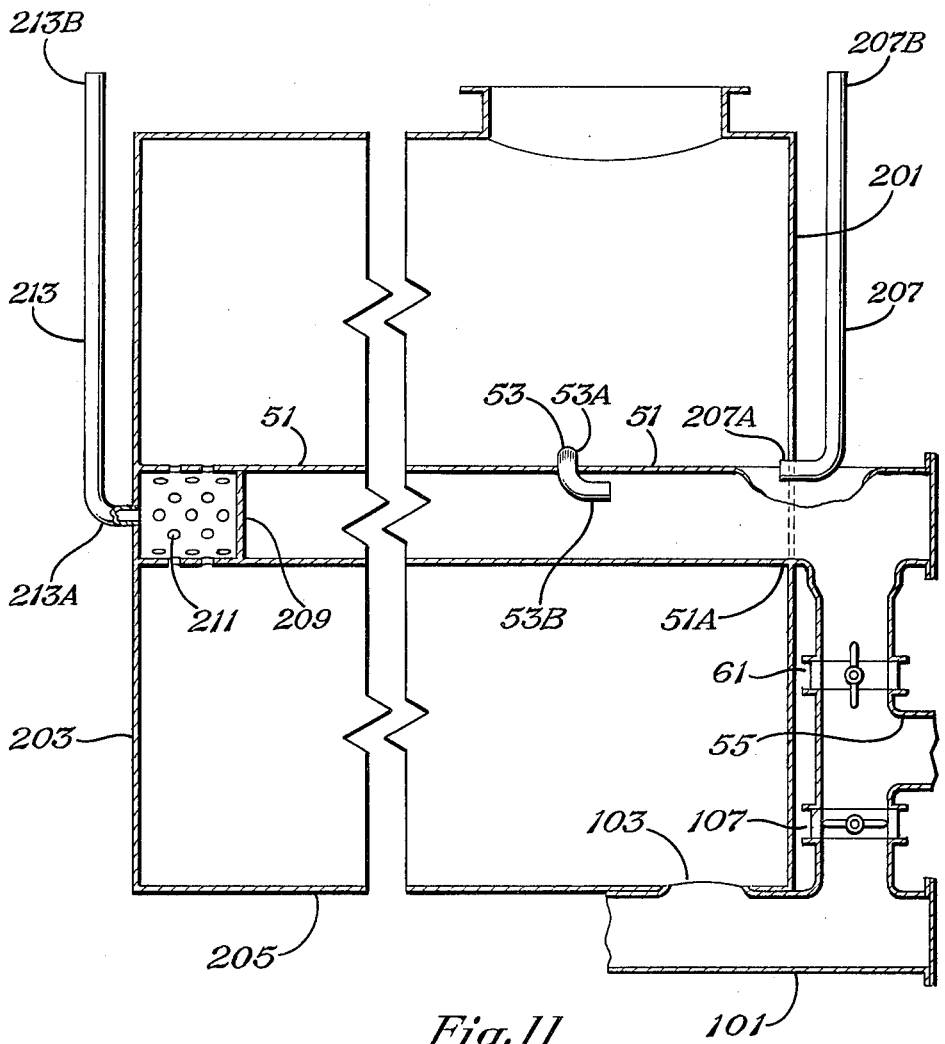
FIG. 11 is a side cross-sectional view of the container of FIG. 10 illustrating air bleeds.
Figure 18:
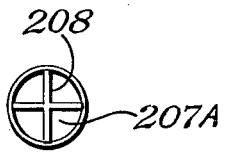
FIG. 18 is an end view of the air bleed of FIG. 17 as seen from lines 18—18 thereof.
Figure 17:
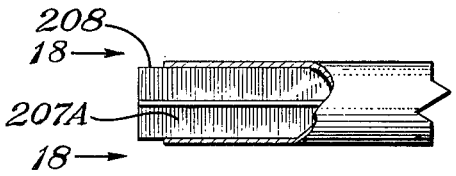
FIG. 17 is an enlarged partial cross-sectional view of the inlet end of an air bleed illustrating baffles located therein.

Due to the swirling action of fluid around the walls of the container 33, an axial low pressure zone exists at the center of the circulation which is where suction conduit 51 is located. In some cases, it has been found that this low pressure results in the occurrence of air at the center of the circulation which enters suction conduit 51 through conductors 53. This is undesirable since it results in the pump 57 trying to pump air which reduces the performance of the pump. This problem may be reduced if not eliminated by providing an air bleed to bleed off the air at the low pressure zone to prevent it from entering suction conduit 51. The air bleed may comprise a conduit extending through one of the end walls or bulk-heads of the container 33. In FIGS. 10 and 11, the end walls of the container 33 are identified at 201 and 203 and the cylindrical wall of the container 33 is identified at 205. In FIG. 11, only one inductor 53 is illustrated, however, it is to be understood that more will be employed, as described previously, as well as the other equipment and components of FIG. 4 for withdrawing the liquid from container 33 by way of the suction conduit 51 and recirculating it by way of pump 57 header 62 and the plurality of spaced apart injector conduits 71. In FIG. 10 and on the right portion of FIG. 11, the air bleed comprises a conduit 207 having an open end 207B extending through bulk-head 201 into the container at a position near suction conduit 51 and hence near the axis around which the fluid swirls. The other end 207B of conduit 207 extends upward above the fluid level in the container 33 and is open to the atmosphere. During mixing operations, air near suction conduit 51 is bled off through conduit 207 and hence does not enter the suction conduit. As shown in FIGS. 17 and 18, baffles 208 are located in the open end 207B of air bleed 207 to prevent the swirl of fluid in bleed 207 thereby converting the kenetic action of any swirling action to a static pressure. Baffles 208 are not shown in the open end 207B of bleed 207 in FIG. 11 for purpose of clarity.

The left portion of FIG. 11 illustrates an air bleed arrangement that may be employed in lieu of or in addition to the air bleed 207. Suction conduit 51 has a circular plate 209 connected on its inside at a point spaced inward of bulk-head 203. A seal is formed between plate 209 and conduit 51 and apertures 211 are formed through conduit 51 to the left plate 209. A bleed conduit 213 has an open end 213A extending through bulk-head 203 at about the axis of conduit 51 and is in fluid communication with container 33 by way of the inside portion of conduit 51 to the left of plate 209 and apertures 211. The other end 213B of conduit 213 extends upward above the fluid level in the container 33 and is open to the atmosphere. During mixing operations, air near suction conduit 51 flows through apertures 211 and is bled off through conduit 213. Although not shown in FIG. 11, the open end 213A of bleed 213 will have baffles similar to those shown at 208 in FIGS. 17 and 18.

Figure 12:
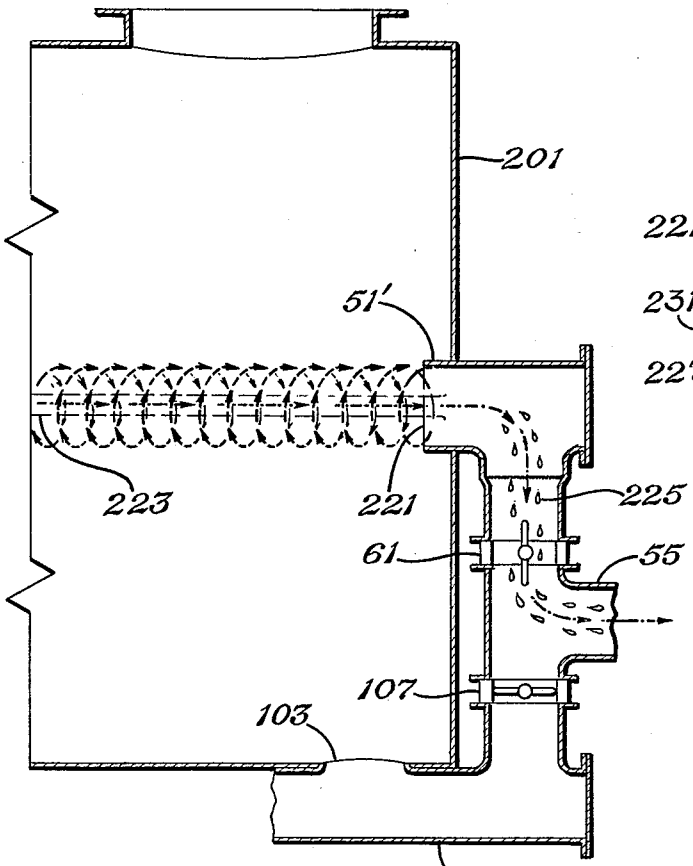
FIG. 12 is a partial side cross-sectional view of a container illustrating a short center suction conduit.

A center suction conduit may be employed which extends only a short distance into the container 33 through bulk-head 201 or which could be flush with bulk-head 201. A suction conduit extending only a short distance into container 33 is illustrated in FIG. 12 at 51'. In this embodiment, liquid from the container 33 flows into conduit 51' through its opening 221. The other equipment and components of FIG. 4 will be employed for withdrawing the liquid from the container 33 by way of suction conduit 51' and recirculating it by way of pump 57, header 62 and the plurality of spaced apart injector conduits 71. A larger pump and motor would be required than that employed with the system of FIGS. 4 and 6 to achieve the same results.

Figure 13:
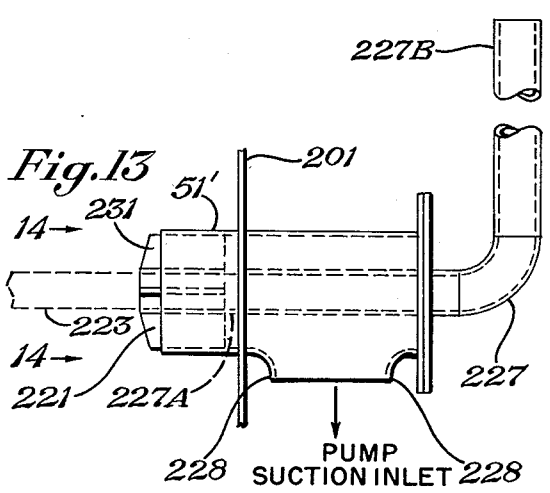
FIG. 13 illustrates the short center suction conduit of FIG. 12 with an air bleed and baffles.
Figure 14:
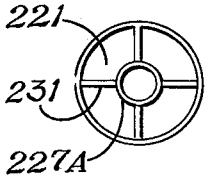
FIG. 14 is an end view of the center suction conduit of FIG. 13 as seen from lines 14—14 thereof.

A low pressure zone will exist along the central axis of the circulation pattern and with a sufficient rate of circulation, an air core illustrated at 223 may be formed. This may introduce some air into the pump which is undesirable as mentioned above. In FIG. 12, air bubbles flowing to the pump inlet 55 are illustrated at 225. The air is prevented from reaching the pump by a provision of an air bleed as shown in FIGS. 13 and 14. The air bleed comprises a conduit 227 having an end 227A extending into suction conduit 51' through its outside wall to a position past the vertical portion 228 of the connection of conduit 51' to pump inlet 55 and preferably at least inside the bulk-head 201. The other end 227B of conduit 227 extends upward above the fluid level of container 33 and is open to the atmosphere. In FIGS. 13 and 14, members 231 are baffles located inside of shortened suction conduit 51' at or near its opening 221 to prevent the swirl of fluid inside of suction conduit 51'. The swirl of fluid inside of suction conduit 51' is undesirable since it creates a force which opposes flow to the pump and causes a low pressure at the center of the conduit which can cause cavitation in the pump. Although not shown in FIGS. 13 and 14, the open end 227A of air bleed 227 will have baffles similar to those shown at 208 in FIGS. 17 and 18.

Figure 15:
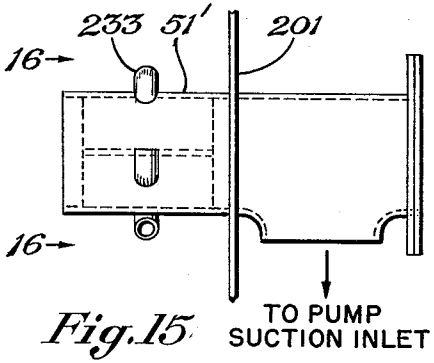
FIG. 15 illustrates a short center suction conduit with baffles and inductors.
Figure 16:
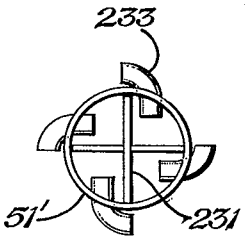
FIG. 16 is an end view of the center suction conduit of FIG. 15 as seen from lines 16—16 thereof.

In FIGS. 15 and 16, inductors 233 are provided to convert velocity of the fluid to pressure. The inductors 233 do not have their inner ends facing the direction of flow of fluid in the suction conduit to the pump as do inductors 53. The baffles 231 and inductors 233 together perform the same function as the inductors 53 with their special configuration. Although an air bleed is not shown in the embodiment of FIGS. 15 and 16, it is to be understood that an air bleed similar to the bleed 227 of FIGS. 13 and 14 may be employed. Such an air bleed also will have baffles in its open end similar to those shown at 208 in FIGS. 17 and 18.

It is to be understood further, that the teachings of the embodiments of FIGS. 10–18 may be employed in the types of mixing systems of FIGS. 8 and 9.

What is claimed is:

1. A fluid mixing system comprising:

a container having a given length, injection means for injecting fluid into said container at a plurality of spaced apart positions along its length and in a direction to cause the fluid to swirl around an axis extending along the length of said container, conduit means having inlet means in fluid communication with the interior of said container near said axis for the flow of fluid from said container into said conduit means, air bleed means having inlet means in fluid communication with the interior of said container near said axis for removing air from said container near said axis, and means for withdrawing fluid from said conduit means and for flowing said withdrawn fluid into said injection means for injection back into said container.

2. A fluid mixing system comprising:

a container defined by two spaced apart generally vertical end walls and side wall means extending between said end walls, the distance between said end walls defining the length of said container, injection means for injecting fluid into said container at a plurality of spaced apart positions along its length and in a direction to cause the fluid to swirl around a generally horizontal axis entending along the length of said container, conduit means having inlet means in fluid communication with the interior of said container near said axis for the flow of fluid from said container into said conduit means, air bleed means having inlet means in fluid communication with the interior of said container near said axis for removing air from said container near said axis, and means for withdrawing fluid from said conduit means and for flowing said withdrawn fluid into said injection means for injection back into said container.

* * * * *